US007318540B1

(12) United States Patent
Sutton et al.

(10) Patent No.: US 7,318,540 B1
(45) Date of Patent: Jan. 15, 2008

(54) INDICATOR FOR GARMENT HANGER

(75) Inventors: Steven Sutton, Brooklyn, NY (US); Leslie Blitz, New Hyde Park, NY (US)

(73) Assignee: The Accessory Corp., New York, NY (US)

( * ) Notice: Subject to any disclaimer, the term of this patent is extended or adjusted under 35 U.S.C. 154(b) by 0 days.

(21) Appl. No.: 11/423,033

(22) Filed: Jun. 8, 2006

(51) Int. Cl.
*A41D 27/22* (2006.01)

(52) U.S. Cl. ..... 223/85; 40/322

(58) Field of Classification Search ..... 223/85, 223/88, 92, 95, 98, DIG. 4, 96; 40/322, 40/376, 672; D6/315, 316, 328; 211/85.3
See application file for complete search history.

(56) References Cited

U.S. PATENT DOCUMENTS 2,769,587 A * 11/1956 Threeton ..... 294/142
2,878,978 A * 3/1959 Glowka ..... 223/98
3,024,953 A * 3/1962 O'Keefe ..... 223/88
3,554,418 A * 1/1971 Holmes ..... 294/142
3,885,723 A * 5/1975 Magnie ..... 294/142
3,898,754 A 8/1975 Johansson
3,949,914 A * 4/1976 Ostroll ..... 223/85
4,045,899 A 9/1977 Richardson
4,123,864 A 11/1978 Batts et al.
4,137,661 A 2/1979 Johansson
4,160,333 A 7/1979 Indelicato
4,198,773 A 4/1980 Btts et al.
4,288,012 A * 9/1981 Doak ..... 294/143
4,322,902 A * 4/1982 Lenthall ..... 40/322
4,333,590 A * 6/1982 Princiotta ..... 223/85
4,382,531 A * 5/1983 Bisk et al. ..... 223/91
4,450,639 A 5/1984 Duester
4,679,340 A 7/1987 Johansson
4,881,836 A 11/1989 Blanchard
4,886,195 A 12/1989 Blanchard
4,997,114 A 3/1991 Petrou
5,096,101 A 3/1992 Norman et al.
5,135,141 A 8/1992 Harmer et al.
5,238,159 A 8/1993 Zuckerman
5,305,933 A 4/1994 Zuckerman
5,377,884 A 1/1995 Zuckerman
5,381,938 A * 1/1995 Vasudeva ..... 223/85
5,383,583 A 1/1995 Zuckerman
5,388,354 A 2/1995 Marshall et al.
5,407,109 A 4/1995 Zuckerman
5,441,182 A 8/1995 Sullivan (Continued)

FOREIGN PATENT DOCUMENTS

GB 2064472 A * 6/1981

*Primary Examiner*—Gary L. Welch
*Assistant Examiner*—Nathan E Durham
(74) *Attorney, Agent, or Firm*—Gordon & Jacobson, PC

(57) ABSTRACT

A top indicating means for a hanger having a metal hook includes two mounting portions and an indicator. Each of the mounting portions includes a base defining a curved channel, engagement structure to couple the mounting portions together, and preferably alignment structure for aligning the mounting portions relative to each other. Each of the mounting portions also includes an indicator support having a web and locking structure for locking the indicator on the web. In use, the mounting portions are positioned on either side of the upper portion of the metal hook of the hanger and locked together. The indicator is then pushed over the top of the adjacent web portions and locked thereon.

9 Claims, 4 Drawing Sheets

U.S. PATENT DOCUMENTS 5,449,099 A 9/1995 Blanchard
5,469,995 A 11/1995 Bredeweg et al.
5,477,995 A 12/1995 Dooley et al.
5,485,943 A 1/1996 Zuckerman
5,503,310 A 4/1996 Zuckerman et al.
5,524,801 A 6/1996 Dooley et al.
5,586,697 A 12/1996 Johansson
5,590,822 A 1/1997 Zuckerman
5,597,100 A 1/1997 Blitz
5,603,437 A 2/1997 Zuckerman
5,611,469 A 3/1997 Eiley et al.
5,613,629 A 3/1997 Zuckerman
5,628,132 A 5/1997 Marshall et al.
5,641,100 A 6/1997 Mitchell et al.
5,642,840 A 7/1997 Abdi
D383,910 S * 9/1997 Maxwell ..... D6/328
5,683,018 A 11/1997 Sullivan et al.
5,687,887 A 11/1997 Bond et al.
5,775,553 A 7/1998 Marshall et al.
5,778,575 A * 7/1998 Deupree et al. ..... 40/322
5,785,216 A 7/1998 Gouldson et al.
5,797,640 A * 8/1998 Schopfer ..... 294/152
5,819,995 A 10/1998 Zuckerman
5,857,276 A 1/1999 Marshall et al.
5,884,422 A 3/1999 Marashall et al.
5,913,462 A 6/1999 Petrou
5,944,237 A 8/1999 Gouldson
5,950,883 A 9/1999 Bond et al.
6,019,260 A 2/2000 Gouldson
6,041,983 A 3/2000 Sullivan et al.
6,145,713 A 11/2000 Zuckerman
6,189,746 B1 2/2001 Gouldson
6,209,241 B1 4/2001 Louw
6,260,745 B1 7/2001 Gouldson et al.
6,264,075 B1 7/2001 Gouldson et al.
6,378,744 B2 4/2002 Olk et al.
6,382,478 B2 5/2002 Gouldson et al.
6,422,437 B2 7/2002 Gouldson et al.
6,499,633 B1 12/2002 Pogmore
6,499,634 B2 12/2002 Olk et al.
6,564,980 B2 5/2003 Gouldson et al.
6,622,897 B2 9/2003 Bokmiller et al.
6,681,966 B2 1/2004 Gouldson et al.
6,705,496 B2 3/2004 Marshall et al.
6,726,067 B2 4/2004 Louw
6,932,251 B2 8/2005 Kolton et al.
2006/0011673 A1 * 1/2006 Gouldson ..... 223/85

* cited by examiner

INDICATOR FOR GARMENT HANGER

RELATED APPLICATIONS

This application is related to U.S. Ser. No. 10/852,246, filed May 24, 2004, which is hereby incorporated by reference herein in its entirety.

BACKGROUND OF THE INVENTION

1. Field of the Invention

This invention relates broadly to garment hangers. More particularly, this invention relates to a removable top size indicator for garment hangers.

2. State of the Art

For purposes of displaying garments suspended on hangers in an orderly and informative manner to the retail customer, certain retail stores use hangers with an indicator where the indicator is visible to the customers. The indicator identifies some attribute of the garment suspended from the hanger, such as size, quality, color, manufacturing data, or pattern.

To accommodate the various types of hangers available in the industry, numerous top indicators have been developed in a variety of shapes, sizes and materials. Specialty hangers including a molded plastic hook are relatively inexpensive to manufacture and are used to hold lighter weight garments. Given that the hook is molded, it has been relatively easy to modify the hook portion of the hanger to accommodate a variety of different indicators at the top of the hanger. Generally, the molded hook is formed with an upper web, and a commonly rectangular indicator is then engaged over the web. This has not been an option for metal hook hangers.

Hangers with metal hooks are extremely common. They are primarily used to hold heavier garments, e.g., pants and jackets. The metal hooks do not have dedicated structure for receiving and maintaining a highly visible indicator in a desired orientation. The indicators for metal hook hangers are generally either disc-like tally indicators positionable over the hook and seatable on the hanger at the location where the hook and hanger are joined, or "side-sizer" indicators which snap over a specially designed portion of the hanger below the hook. Each such indicator has less than desirable visibility because the location of attachment limits its size and the indicator is positioned below the hanger support bar when the hanger and garment are displayed in the retail environment.

SUMMARY OF THE INVENTION

It is therefore an object of the invention to provide a top indicating means for a hanger with a metal hook.

It is another object of the invention to provide a top indicating means that can easily be attached in the factory or at the retail environment.

It is a further object of the invention to provide top indicating means that requires few components.

It is also an object of the invention to provide a top indicating means that is difficult for the customer to remove, but which can be removed.

It is an additional object of the invention to provide a top indicating means that when removed from the hanger causes no damage to the hanger.

In accord with these objects, which will be discussed in detail below, a top indicating means for a hanger having a metal hook is provided. More specifically, the hanger for which the indicator is designed generally includes a horizontally extending support bar provided with one or more garment coupling means (e.g., clamps or clips) and an upwardly extending metal hook formed of stiff metal wire. The indicating means comprises two preferably hermaphroditic mounting portions and an indicator. Each of the mounting portions includes a base defining a permanently curved channel, engagement structure to couple the two mounting portions together, and preferably alignment means for aligning the mounting portions relative to each other. Each of the mounting portions also includes an indicator support having a web, means to lock the indicator on the web, and preferably side walls. Structure also may be included to further limit sliding movement of the mounting portions along the hook.

In use, the two mounting portions are positioned on either side of the upper portion of the metal hook of the hanger and are locked together about the hook with the engagement structure. The hook is positioned within the respective channels. The indicator is then pushed over the top of the respective web portions until the means to lock the indicator on the web locks the indicator in position.

It will be appreciated that the indicating means may be used on any garment hanger having a metal wire hook. Once attached, it is resistant to removal. However, if desired, the indicating means may be removed from the hook (using an appropriate tool) without any destruction to the garment hanger.

Additional objects and advantages of the invention will become apparent to those skilled in the art upon reference to the detailed description taken in conjunction with the provided figures.

DETAILED DESCRIPTION

Figure 1:
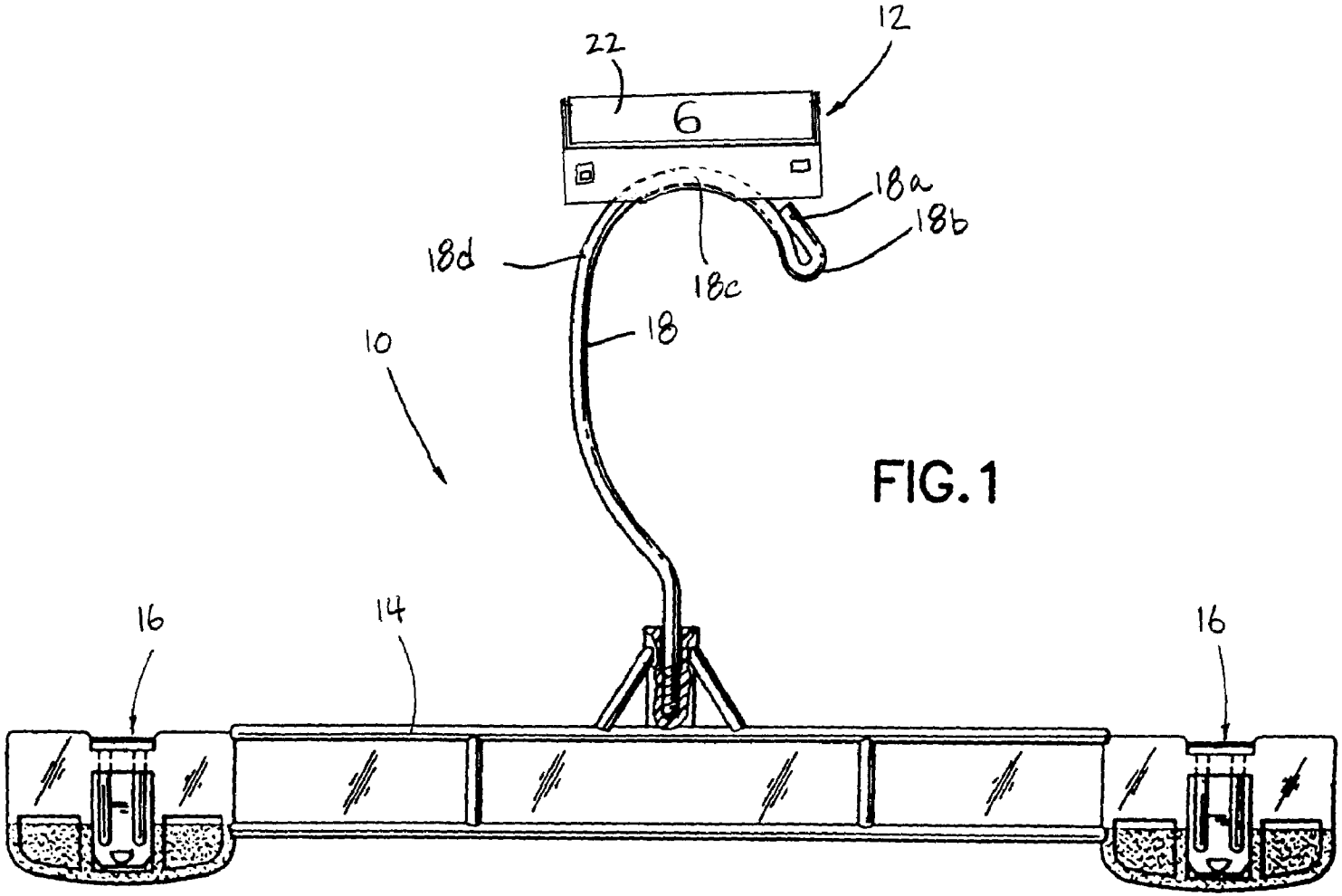
FIG. 1 is a side elevation of a metal-hook garment hanger provided with an indicating means according to the invention.

Turning now to FIG. 1, a garment hanger 10 provided with a top indicating means 12 according to the invention is shown. The garment hanger 10 is a common metal hook hanger known in the art, although the invention described in FIG. 1 and the associated figures relates to any metal hook hanger. Hanger 10 includes a generally horizontally extending support bar 14 provided with a garment clamp 16 at each end thereof, and an upwardly extending metal hook 18 formed of stiff metal wire coupled to the support bar 14 for suspending the hanger 10 from a rod. The end of the wire forming the hook 18 includes an upwardly bent portion 18*a* that presents a blunt end 18*b* to the hook, providing strength to the end and preventing customer injury and damage to clothing which may come into contact with it. A ball end may alternatively be provided to the hook.

Figure 2:
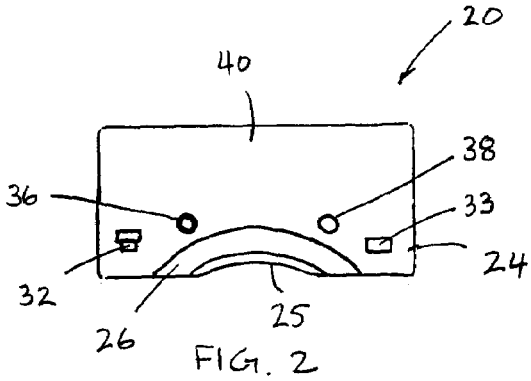
FIG. 2 is a side elevation directed toward an inner surface of a mounting portion of an indicating means according to the invention.
Figure 3:
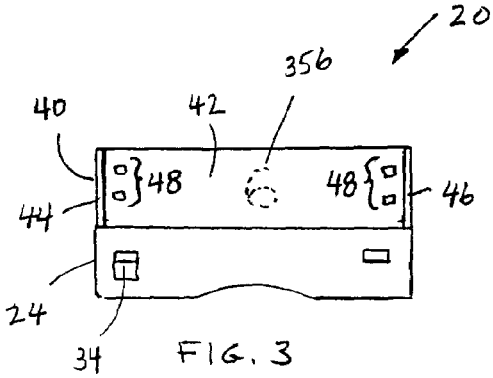
FIG. 3 is a side elevation directed toward an outer surface of the mounting portion of the indicating means.

Referring to FIGS. 1 through 3, the indicating means 12 comprises two preferably hermaphroditic mounting portions 20 and an indicator 22. The use of hermaphroditic mounting portions 20 limits the number of components required for the system. Each of the mounting portions 20 includes a lower base 24 defining a curved lower surface 25, a channel 26 permanently curved along a preferably constant radius, engagement structure to couple the two mounting portions 20 together, and preferably alignment means for aligning the mounting portions relative to each other. In accord with the preferred embodiment, the constant radius of curved channel 26 corresponds to the radius of curvature along the top portion 18*c* of the hook (FIG. 1), the engagement structure comprises a barb 32 and a corresponding hole 33 with catch 34 on each of the mounting portions 20, and the alignment means includes a nub 36 and corresponding hole or recess 38 (collectively referred to as 'recesses') on each of the mounting portions 20. Each of the mounting portions 20 also includes an upper indicator mounting portion 40 having a web 42, locking means to lock the indicator 22 (FIG. 1) on the web 42, and preferably side walls 44, 46 to laterally constrain the indicator. The preferred locking means includes two laterally displaced sets of two nubs 48 or other protrusions, as shown and described in previously incorporated U.S. Ser. No. 10/852,246.

Figure 4:
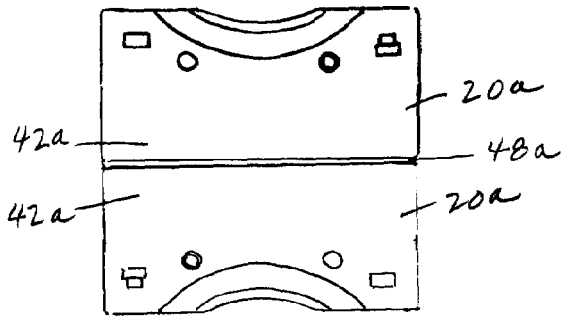
FIG. 4 is a side elevation of an embodiment of an alternate embodiment of a mounting portion of the indicating means.

According to an alternate embodiment shown in FIG. 4, the two mounting portions 20*a* may be formed together, e.g., with a live hinge 48*a* between two web portions 42*a*. The mounting portions may be bent into alignment about the hinge 48*a*.

Figure 5:
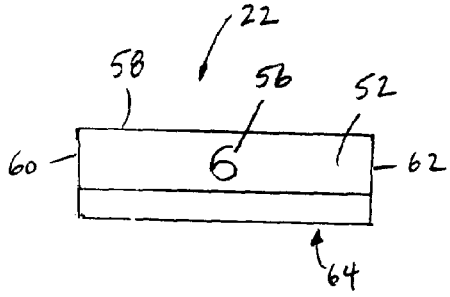
FIG. 5 is a side elevation of an indicator of the indicating means.
Figure 6:
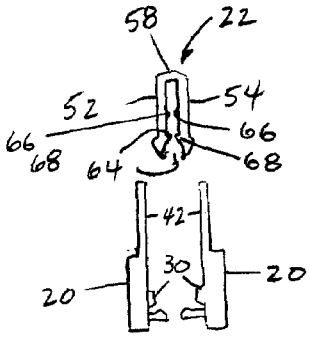
FIG. 6 is an exploded end view of an indicating means for a wire hook hanger according to the invention.
Figure 7:
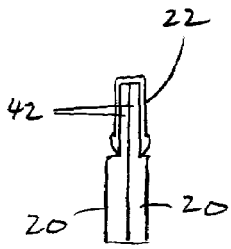
FIG. 7 is an assembled end view of the indicating means of FIG. 6.

Referring to FIGS. 5 and 6, the indicator 22 is substantially as shown and described in previously incorporated U.S. Ser. No. 10/852,246. Generally, the indicator 22 includes two substantially parallel and planar sides 52, 54 with indicia 56, a closed top 58, open ends 60, 62, and an open bottom 64. The sides 52, 54 include inwardly extending mating elements 66, 68 which are adapted to engage with the locking means, e.g., nubs 48, on the web 42 (FIG. 3). In the embodiment shown, the mating element at each end of each side includes a pair of catches 66, 68 which are shaped to facilitate movement over nubs 38 (FIG. 2) but which resist removal from over the nubs.

Referring to FIGS. 1, 2, 3, 6 and 7, in use, the two mounting portions 20 are positioned on either side of the upper portion of the metal hook of the hanger, with the upper portion 18*c* of the hook residing in the channels 26 of the respective portions 20 and the two web portions 42 lying against each other. The two channels 26 define a common pathway for the upper portion 18*c* of the hook. The alignment means 30 facilitates such alignment. The mounting portions 20 are locked together about the upper portion 18*c* of the hook 18 with the engagement structure; for example, by having barbs 32 engage relative to catches 34. The indicator 22 is then pushed over the top of the two adjacent web portions 42 until the mating elements 66, 68 on the indicator 22 lock relative to the locking means (e.g. nubs 48) on the mounting portions 20 to retain the indicator 22 in position at the top of the hanger. The indicating means 12 is retained at the upper portion 18*c* of the hook 18, as rotation along the hook toward the end 18*b* is prevented by the upturned wire 18*a*, and rotation in the opposite direction is limited by the different radius of curvature along the wire at portion 18*d* which does not fit through the curved channels 26 as well as the upper portion 18*c* of hook 18 (FIG. 1).

Figure 8:
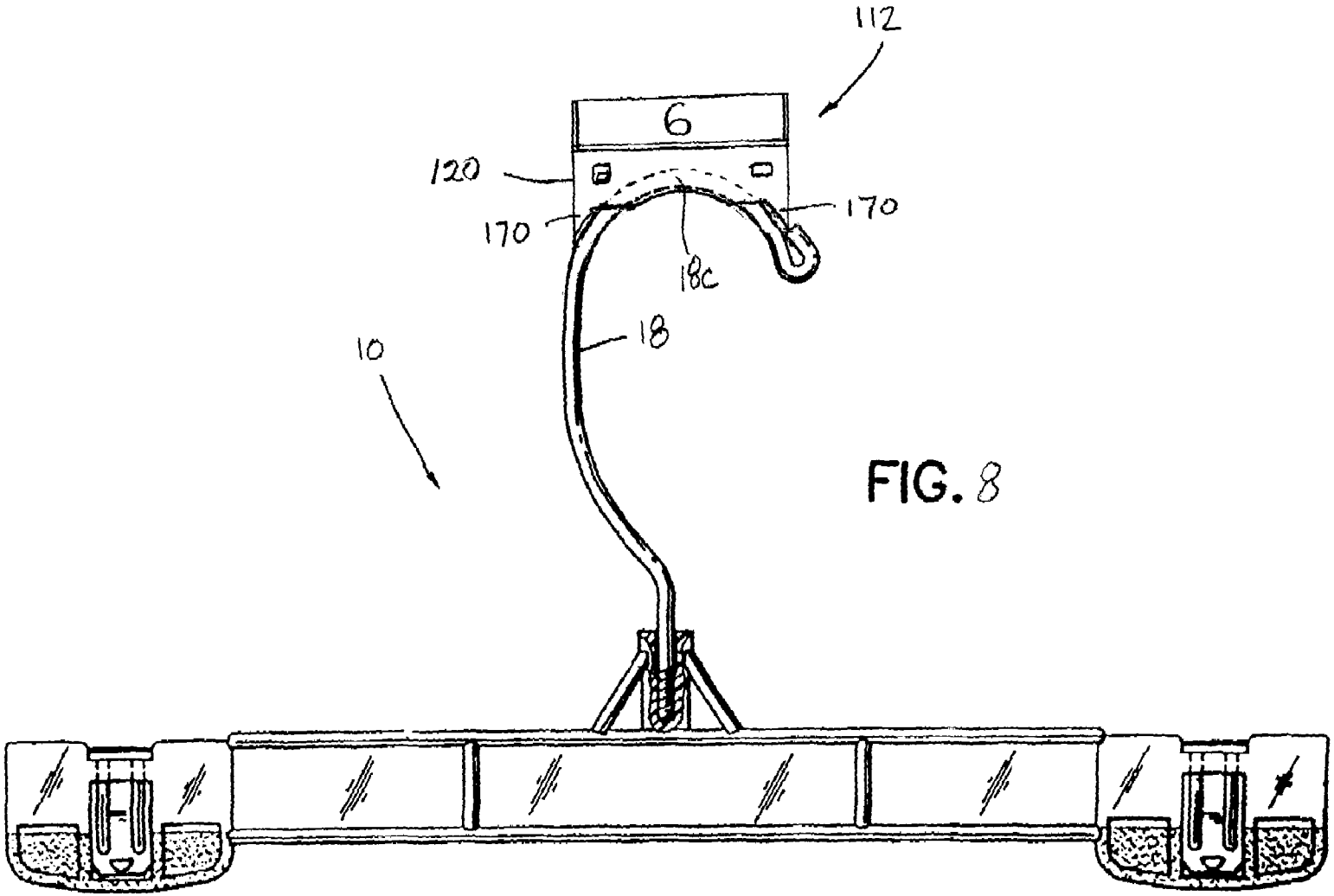
FIG. 8 is a side elevation of a garment hanger provided with a second embodiment of an indicating means according to the invention.

Referring now to FIG. 8, another embodiment of the indicator mounting portions 120, substantially similar to portion 20, are shown. Such portions 120 include front and rear stops 170 that limit the permitted amount of sliding travel once the mounting portions 120 are coupled about upper hook portion 18*c* of the hanger 10.

Figure 9:
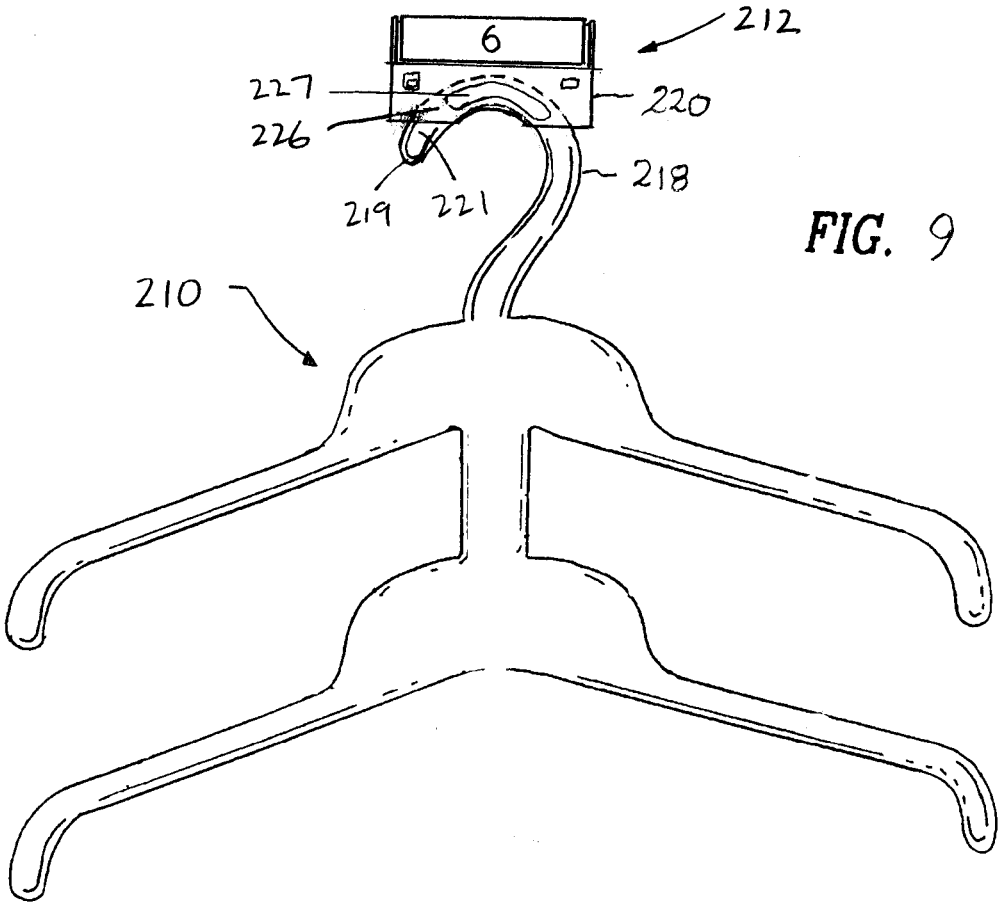
FIG. 9 is a side elevation of a plastic-hook garment hanger provided with a third embodiment of an indicating means according to the invention.

Turning now to FIG. 9, it is recognized that while the indicating means has been described with respect to metal hook type hanger, the system can be adapted to any plastic hook hanger, e.g., hanger 210. In such application, indicator mounting portions 220 each preferably include a channel 226 sized and shaped to received a portion of the plastic hook 218. Such a plastic hook 218 often has a raised edge 219 to increase the strength of the hook, and such edge defines a recess in the hook 218. In order to facilitate retention of the indicating means on the hook, the channels 226 each preferably includes a protuberance 227 that resides within the recess 221 when coupled about the hook 218.

It is appreciated that in any of the prior embodiments the indicating means may be used without the indicator 22. In such embodiment, the mounting portions or web portions 42 thereof may be molded in colors, provided with indicia (e.g., indicia 356, FIG. 3), etc. so as to provide a consumer with garment information.

It will be appreciated that the indicating means may be used on any garment hanger having a hook and easily attaches in either the factory or retail environment. In addition, once attached, it is resistant to removal. Therefore, the system is safe to use in retail environments where children may have access to the hangers, as no small parts can be easily separated from the hanger. In addition, as the indicators and mounting portions are resistant to removal, the system helps maintain a tidy retail appearance, with no indicators on the floor.

However, if desired, the indicating means may be removed from the hook (using an appropriate tool). Upon removal, the sturdy garment hanger and hook will not be damaged and can be re-used with or without indicating means in the future.

There have been described and illustrated herein embodiments of an indicating means for a garment hanger. While particular embodiments of the invention have been described, it is not intended that the invention be limited thereto, as it is intended that the invention be as broad in scope as the art will allow and that the specification be read likewise. Thus, while particular types of hangers have been shown, it will be appreciated that the invention applies to any type of hanger including, without limitation, clamp-type hangers, pinch-type hangers, lingerie hangers, top hangers, bottom hangers, outerwear and sweater hangers, top/bottom set hangers, etc. Also, while particular engagement structure for coupling the two mounting portions about the hanger has been disclosed, it will be appreciated that other suitable engagement structure may be used as well. In addition, while a particular indicator, and locking structure for locking such indicator on the web have been disclosed, it will be understood that an indicator of another shape or configuration can be used, and that other locking structure for coupling the indicator relative to the mounting portions can be used. For example, and not by way of limitation, the web may include elongate ridges instead of nubs and no side walls, and the indicator may have closed ends and substantially fully enclose the web portions when seated thereon.

Furthermore, while the channel in the mounting portion is described as curved (for receiving the curved portion of a hanger), it is appreciated that the channel may be configured in any shape suitable for the upper portion of the hanger for which it is intended. It will therefore be appreciated by those skilled in the art that yet other modifications could be made to the provided invention without deviating from its scope as claimed.

What is claimed is:

1. A garment hanger indicating system for a garment hanger having a hook, comprising:

a) an indicator;

b) a first mounting portion including a base and a support for said indicator, said base defining a rigid channel and first engagement structure, said indicator support having an indicator retainer cooperating with said indicator to retain said indicator on said support; and c) a second mounting portion discrete from said first mounting portion and including a base and a support for said indicator, said base of said second mounting portion defining a rigid channel and second engagement structure, said first and second engagement structures adapted to couple said first and second mounting portions together about a portion of the hook, said supports of said first and second mounting portions being adjacent each other when said first and second mounting portions are coupled together, said channels of said first and second mounting portions being in alignment when said first and second mounting portions are coupled together to define a common pathway for the portion of the hook of the garment hanger, said first and second mounting portions structured such that said first and second mounting portions can only be placed over the portion of the hook when decoupled from each other, and when in a coupled relationship about the portion of the hook said first and second mounting portions are prevented from being removed therefrom unless decoupled from each other.

2. A garment hanger indicating system for a garment hanger having a hook, comprising:

a) an indicator;

b) a first mounting portion including a base and a support for said indicator, said base defining a rigid channel and first engagement structure, said indicator support having an indicator retainer cooperating with said indicator to retain said indicator on said support;

c) a second mounting portion discrete from said first mounting portion and including a base with second engagement structure said first and second engagement structures adapted to couple said first and second mounting portions together about a portion of the hook, said first and second mounting portions structured such that said first and second mounting portions can only be placed over the portion of the hook when decoupled from each other, and when in a coupled relationship about the portion of the hook said first and second mounting portions are prevented from being removed therefrom unless decoupled from each other; and d) alignment means for aligning the first and second mounting portions relative to each other, said alignment means including corresponding protuberances and recesses on said first and second mounting portions.

3. A garment hanger indicating system for a garment hanger having a hook, comprising:

a) an indicator;

b) a first mounting portion including a base and an indicator support, said base defining a rigid channel and engagement structure, said indicator support having an indicator retainer cooperating with said indicator to retain the indicator on said indicator support; and c) a second mounting portion discrete from said first mounting portion that is identical to said first mounting portion, said first and second mounting portions being coupled by said engagement structure, said first and second mounting portions structured such that said first and second mounting portions can only be placed over the portion of the hook when decoupled from each other, and when in a coupled relationship about a portion of the hook said first and second mounting portions are prevented from being removed therefrom unless decoupled from each other.

4. An indicating system according to claim 3, wherein:

said channels of said first and second mounting portions are curved, and when said first and second mounting portions are coupled together said channel together define a common pathway for a portion of the hook of the garment hanger.

5. An indicating system according to claim 3, wherein:

said channels are curved along a constant radius.

6. An indicating system according to claim 3, further comprising:

alignment means for aligning the first and second mounting portions relative to each other.

7. An indicating system according to claim 6, wherein:

said alignment means includes corresponding protuberances and recesses on said first and second mounting portions.

8. An indicating system according to claim 3, wherein:

said support for said indicator includes a web and said indicator retainer includes protrusions extending from said web.

9. An indicating system according to claim 3, wherein:

said indicator includes indicia of a garment size.

* * * * *